US008875794B2

(12) United States Patent
Carlsen et al.

(10) Patent No.: US 8,875,794 B2
(45) Date of Patent: Nov. 4, 2014

(54) TRIGGER JOINT

(75) Inventors: Hans-Paul Carlsen, Notodden (NO); Tor-Øystein Carlsen, Kongsberg (NO); John A. Johansen, Kongsberg (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 145 days.

(21) Appl. No.: 13/138,371

(22) PCT Filed: Feb. 5, 2010

(86) PCT No.: PCT/NO2010/000044

§ 371 (c)(1),
(2), (4) Date: Oct. 21, 2011

(87) PCT Pub. No.: WO2010/090531

PCT Pub. Date: Aug. 12, 2010

(65) Prior Publication Data

US 2012/0031622 A1 Feb. 9, 2012

(30) Foreign Application Priority Data

Feb. 9, 2009 (NO) ..... 20090607

(51) Int. Cl.

| | |
|---|---|
| ***E21B 17/07*** | (2006.01) |
| ***E21B 17/02*** | (2006.01) |
| ***E21B 19/09*** | (2006.01) |
| ***E21B 17/08*** | (2006.01) |
| ***E21B 19/00*** | (2006.01) |

(52) U.S. Cl.

CPC ..... *E21B 17/085* (2013.01); *E21B 19/006* (2013.01)

USPC ..... 166/355; 166/352; 166/345; 285/302

(58) Field of Classification Search

USPC ..... 166/345, 352, 355, 367, 378–380, 166/75.14; 285/145.1, 302

See application file for complete search history.

(56) References Cited

U.S. PATENT DOCUMENTS 3,643,751 A 2/1972 Crickmer
3,647,245 A * 3/1972 Hanes et al. ..... 285/106

(Continued)

FOREIGN PATENT DOCUMENTS

EP 0 088 608 A2 9/1983
WO WO 97/43516 A1 11/1997

(Continued)

*Primary Examiner* — Matthew Buck
*Assistant Examiner* — Stacy Warren

(57) ABSTRACT

The present invention regards a joint for use in a riser (1) extending between a floating installation (3) and a subsea installation (2). The joint comprises an inner pipe segment (21) and an outer pipe segments (22), arranged moveable relative each other in an axial direction and connectable to respective riser segments, forming a chamber (23) between them with a radially extending piston (24), dividing the chamber (23) in a first chamber part (25) and a second chamber part (26), wherein on of said chamber parts (25) in an initial position of the joint is adapted to contain a mainly incompressible fluid, this chamber part (25) decreasing in volume as the inner pipe segment (21) is moved relatively out of the outer pipe segment (22). According to the invention the joint is configured with a fluid line connection (30) from said one chamber part (25) to the other chamber part (26), configured such that the relative movement of the pipe segments (21, 22) is controlled by the allowed flow rate of a fluid flowing out of the chamber part (25) through the fluid line connection (30) to the other chamber part (26).

18 Claims, 7 Drawing Sheets

(56) References Cited

U.S. PATENT DOCUMENTS

| | | | | | |
|---|---|---|---|---|---|
| 4,049,239 | A | * | 9/1977 | Howell | 166/355 |
| 4,059,148 | A | * | 11/1977 | Blomsma | 166/359 |
| 4,367,981 | A | | 1/1983 | Shapiro | |
| 4,371,038 | A | * | 2/1983 | Abernathy et al. | 166/380 |
| 4,424,988 | A | | 1/1984 | Cowx | |
| 4,615,542 | A | * | 10/1986 | Ideno et al. | 285/11 |
| 4,712,620 | A | | 12/1987 | Lim et al. | |
| 5,069,488 | A | * | 12/1991 | Freyer et al. | 285/302 |
| 6,017,168 | A | | 1/2000 | Fraser, Jr. et al. | |
| 2001/0040052 | A1 | * | 11/2001 | Bourgoyne et al. | 175/7 |
| 2005/0055163 | A1 | * | 3/2005 | Hopper | 702/6 |

FOREIGN PATENT DOCUMENTS

| | | | | |
|---|---|---|---|---|
| WO | WO 2005/113929 | A1 | | 12/2005 |
| WO | WO 2008051092 | A1 | * | 5/2008 |

* cited by examiner

TRIGGER JOINT

The present invention regards a joint for use in a riser and a method for extending an operation window for a riser.

BACKGROUND OF THE INVENTION

A riser is a pipe extending between a subsea installation and a floating installation for transferring fluids and or signals between equipment at the two installations. There may be produced hydrocarbons, drilling fluids, injection fluids, etc. transferred by the riser. The floating installation which will move due to changing weather conditions, wind waves, currents, etc. is normally given a safe operation window. Such a safe operation window may for instance define an area wherein the installation may move without danger of damaging the equipment, wind conditions where the installation can be kept within this area, etc. However, there are emergency situations where the floating installation will no longer be within such a safe operation window or is in the process of leaving such a safe operation window. These are normally referred to as drift off or drive off situations dependent on the incident occurring. One will normally release the floating installation from the subsea installation by activating an Emergency Quick Disconnect Package (EQDP) when or before such situations occur.

The problem is to have enough time for the execution of an emergency disconnect in the event of an emergency situation. In a drift off/drive off situation of the floating installation, or if the heave compensator fails, there is normally very little time available to disconnect the riser from the wellhead. It has been found that activation of the Emergency Quick Disconnect (EQD) may take more time than is available.

There is therefore a need for increasing the available window for operations of an EQD in a riser, and thereby an increased operational window for a riser.

The object of the present invention is to provide an increased available window for operation of a riser. This is achieved with a joint and a method as defined in the attached claims.

SUMMARY OF THE INVENTION

According to the invention there is provided a joint for use in a riser extending between a floating installation and a subsea installation. The subsea installation may be any installation which is kept in a fixed position relative the seabed. The floating installation may be a vessel, floating platform, or even an installation floating in the water below the surface of the water but still experiencing movement relative the seabed. The joint comprises an inner pipe segment and an outer pipe segment, arranged moveable relative each other in an axial direction of the pipe segments. The pipe segments are connectable to respective riser segments. The joint will then form part of the riser. The pipe segments form a fluid channel through them, normally arranged in line with the fluid channel of the rest of the riser. The pipe segments are configured such that they form a chamber between them. There is in this chamber a radially extending piston, dividing the chamber into a first chamber part and a second chamber part, wherein one of said chamber parts in an initial position of the joint is adapted to contain a mainly incompressible fluid. This chamber part decreases in volume as the inner pipe segment is moved relatively out of the outer pipe segment. The piston is preferably connected to one of said two pipe segments and follows the movement of this pipe segment.

According to the invention the joint is configured with a fluid line connection from said one chamber part to the other chamber part. This fluid line connection is configured such that the relative movement of the pipe segments is controlled by the allowed flow rate of a fluid flowing through the fluid line connection. An outlet from said one chamber part is configured such that the relative movement of the pipe segments is controlled by the allowed flow rate of a fluid flowing out of the chamber part through the outlet. This outlet leads to a fluid connection connecting the one chamber part with the other chamber part. The fluid line connection may be arranged within the piston element, within the walls forming the chamber part, as equipment attached to one pipe segment or as a combination of these.

When tension is applied to the riser, the joint according to the invention will allow some extension in the riser and thereby gain some time for the EQDP to operate before the tension in the riser exceeds threshold values of weak links in the riser. The joint according to the invention will also act as a brake to slow down and control the rate of extension allowed by the joint. This will also result in that there will be adequate tension in the riser at the time the EQD is activated and ensures that the end of the riser will move off the wellhead. There is by controlling the flow out of the chamber part also the possibility to regulate the way the joint extends. There is by the controlled outflow also the possibility of operating the flow out of the chamber part to only begin when a threshold value for the tension in the riser is reached. A threshold value may also be compensated with regards to pressure within the fluid within the riser, as will be explained below.

According to one aspect the fluid line connection may comprise a burst disk. The burst disk will break as a result of a pressure in the chamber part exceeding a predetermined pressure level i.e., a threshold value. The pressure in the chamber part will be a function of the tension in the riser, as the tension in the riser will try to move the inner pipe segment out of the outer pipe segment and thereby try to reduce the size of the chamber part with the incompressible fluid. As long as the fluid is not allowed to flow out of the chamber part the pressure of the fluid within the chamber part is a function of the tension in the riser. A burst disk may also be configured such that only a small amount of fluid is allowed to flow through the fluid line connection in an initial state after a first threshold value is reached, and then as pressure is further increased and a second threshold value is reached the burst disk may then allow a larger flow through the fluid line connection. In this way the rate of the extension may be regulated at different intervals. There may be additional burst disks arranged in the fluid line connection, breaking at different threshold values.

According to another aspect the fluid line connection may comprise a regulating valve. This valve may be any kind of suitable valve. The valve will be operated by signals of the state of the riser. One such signal may be the pressure of the fluid within the chamber part. The valve may have a fully open and a closed state but may also be regulated to have positions between these two states, to allow different partial flows through the fluid line connection and thereby out of the chamber part. By having such a configuration the relative movement of the two pipe segments may be controlled to be a certain way, either a firstly rapid movement when movement is allowed followed by a slower movement close to the end stops of the extension, or vice-versa. This regulating valve may in one embodiment be combined with an initial burst disk.

According to another aspect the joint may comprise control means connected to a sensor for reading the tension in the riser and in response to the sensor readings actuating the regulating valve. The sensors for reading the tension may be arranged relatively above the joint.

According to a further aspect the joint may be configured such that the pressure within said one chamber part acts on a mechanical control device for operating the regulating valve. One such embodiment may comprise a fluid line from said one chamber part to a piston arrangement. The piston arrangement comprises a cylinder with a piston movably arranged within the cylinder, dividing the cylinder in two. The fluid line will be connected to one side of the piston and the pressure in the fluid will act on the piston and move this relative to the cylinder. The piston arrangement operating as a response to the fluid pressure in the chamber part may then act on a mechanical operating arm, for operation of the valve between an open and closed state. By this the opening of the valve will be mechanically linked to the pressure of the fluid within the chamber part.

With a riser having a fluid at a pressure within the riser, this fluid will due to its pressure on an end cap of the riser give tension in the riser. In such an instance it would be favorable that this tension does not activate the brake joint or acts together with an external tension exerted on the riser. There is therefore a need for providing a system which is pressure compensated for internal pressure within the riser. According to an aspect of the invention the joint may be configured such that the pressure within a flow path through the joint acts on a mechanical control device for operating the regulating valve. By this one achieves the internal pressure in the riser as an input value in the mechanical control device. This input will represent a tension in the riser and this may then be withdrawn from the tension experienced in the riser to achieve the tension externally inflicted on the riser.

One possible embodiment of such a solution for a pressure compensated operation of the joint is that the joint may comprise a fluid line extending from an opening towards a flow path through the joint to a piston arrangement. The piston arrangement operating as a response to the fluid pressure in the flow path through the joint may then act on an operating arm, for operation of the valve. This operating arm may may act in an opposite way compared with the influence from the pressure of the fluid within the chamber part. The pressure of the fluid within the chamber part will then have to act against the pressure of the fluid in the riser, and in total reach a threshold value before the valve in the fluid line is operated.

The piston arrangement may according to one embodiment be the same piston arrangement influenced by both the fluid in the chamber part and the fluid within the riser. The fluid in the chamber part may act on one side of a piston and the fluid within the riser may act on the opposite side of the piston, where the piston is connected to an operating arm. The position of the piston which determines the operation of the valve will then be regulated by the difference in pressures within the riser and the chamber part. By this one achieves a pressure compensated system, where the valve is operated as a response to externally inflicted tension in the riser but independent of the pressure of the fluid within the riser.

According to another embodiment the piston arrangement may comprise two cylinders with pistons with a piston rod. These cylinders are connected to respective fluid lines, giving that the position of the respective pistons are determined by the fluid pressure in the respective lines. In this embodiment the operating arm may comprise a lever arm, where the distal ends of the two piston rods act on the lever arm to move the lever arm in opposite rotational directions relative a fulcrum. The lever arm may be extended out on both sides of the fulcrum and the piston rods may be connected to the lever arm on opposite sides of the fulcrum. Alternatively they may act on the same side, in different directions. There will in the different cylinders be arranged spring elements biasing the piston to a neutral state.

There may in the systems also be arranged a mechanical spring element to set a pretension for what tension level the joint will start to engage. The pretension level will then be independent of the pressure within the riser. In the case with the one cylinder arrangement this mechanical spring element may act on one side of the piston preventing opening of the valve unless a threshold value is reach in the fluid within one chamber part. In the case with the lever arm the mechanical spring element may act on the lever arm, here also preventing the valve from opening before there is exerted a given external tension in the riser.

According to another aspect of the invention there may in at least one of the fluid lines between the one chamber part and the piston arrangement or the riser and the piston arrangement be arranged a pressure intensifier. By adapting the pressure intensifier there is also the possibility to introduce drag in the system which allows the extension of the break joint in a controlled manner.

Another possibility to these mechanical solutions for achieving a pressure compensated joint may be to have a sensor reading the internal pressure within the riser and feeding this to the control device for operation of the valve. This may be combined with all the above mentioned solutions.

The present invention also regards a riser extending between a floating installation and a fixed subsea installation, comprising an emergency quick disconnect pack (EQDP). According to the invention a joint as described above is located between the floating installation and EQDP. Preferably the joint is located close to or just above the EQDP in a riser configuration. Alternatively, the joint may be located in a mid part of the riser.

According to an aspect of the present invention the riser may comprise a control unit connected to the joint and to the EQDP, and this control unit may be configured to at least receive signals from the joint, process these and send signals to the EQDP. The signals received from the joint may be one or several signals. The signals may be transmitted through a signal line or possibly remotely. The signals may be pressure readings, extension readings, tension readings or other values in relation to the joint. According to an embodiment the control unit may also receive signals from other parts of the riser. The control unit may also send signals to an operator. The control unit may also be configured to send an activation signal to the EQDP when a given value in the signals is received or the signals indicate a given state of the joint.

According to another aspect of the riser there may be arranged a flex joint between the EQDP and the joint. In one embodiment where the fluid line connection leading fluid out of the chamber part in the joint comprises a valve, the operation of the allowed flow rate through the fluid line connection may also receive signals from sensors in connection with the flex joint for operation of the valve.

The invention also regards a method for increasing the operation window of a riser extending between a floating installation and a fixed subsea installation. The method comprises providing a joint as described above between the floating installation and an EQDP, preferably close to the EQDP, and when the floating installation deviates from its operational area and thereby increases the tension in the riser above a threshold value, the outflow of fluid from the one chamber part is controlled and thereby controls the extension rate of the joint, thereby increasing the available time to release the EQDP.

The invention will now be explained with non-limiting embodiments with reference to the attached drawings;

DETAILED DESCRIPTION OF THE INVENTION

Figure 1:
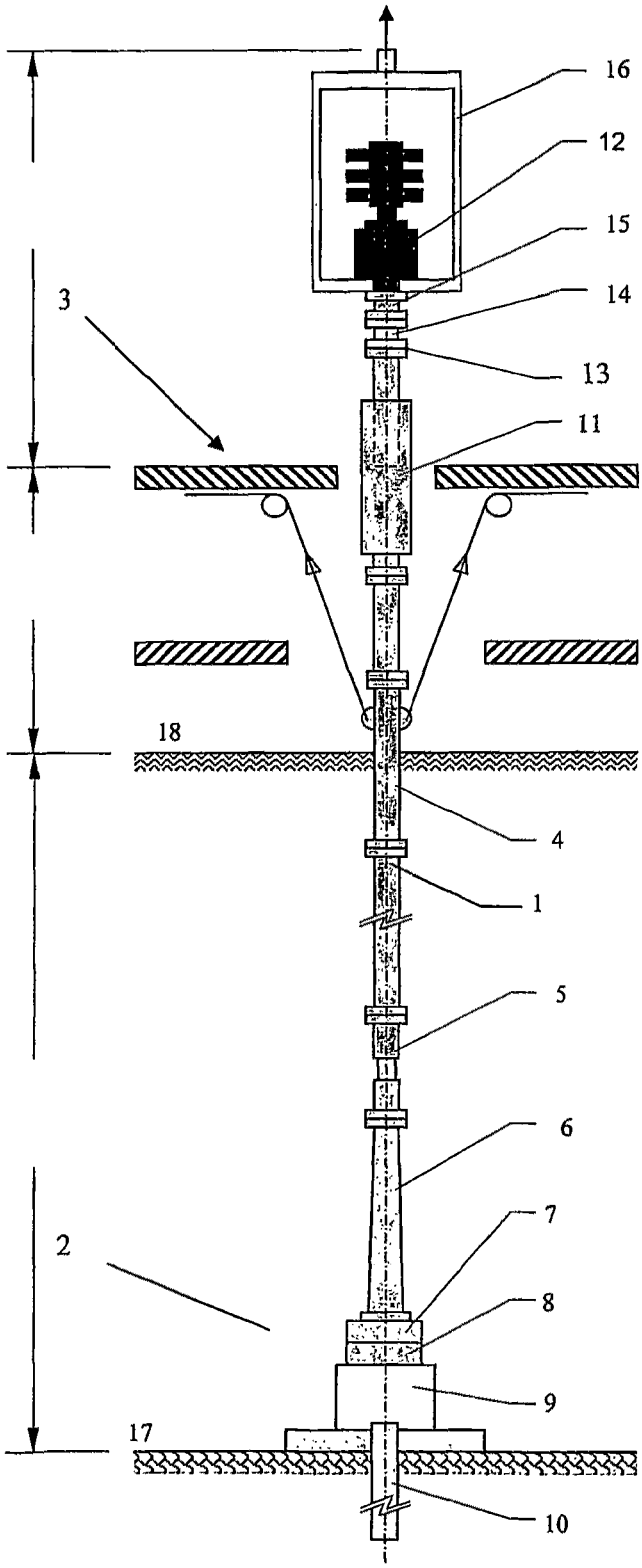
FIG. 1 shows a principle sketch of a normal riser configuration

In FIG. 1 there is shown a normal riser configuration 1 extending between the floating installation 3 and a subsea installation 2. The floating installation 3 has a part of the installation above the water surface 18. As the floating installation 3 floats on the water it will be subjected to varying weather conditions. The subsea installation 2, comprising a wellhead 10 and a subsea tree 9, is kept fixed relative the seabed 17. From the subsea installation the riser 1 comprises an lower riser package 8, an emergency quick disconnect package (EQDP) 7, a stress joint 6, a riser weak link 5 and close to the floating installation a tension joint 4. The riser comprises further above the tension joint a telescopic joint 11, a speed lock 13, a swivel 14, an adapter 15 and a surface BOP 12 arranged in a tension frame 16. This is just one exemplary embodiment of a riser configuration. Some of these elements may be excluded from a riser or there may be additional elements in the riser, dependent on the use of the riser. The stress joint 6 may for instance be switched with a flex joint etc.

According to the invention there is provided a joint for use in a riser. This joint may be arranged in the riser between the emergency quick disconnect package 7 and the floating installation 3, preferably close to the emergency quick disconnect package 7.

Figure 2:
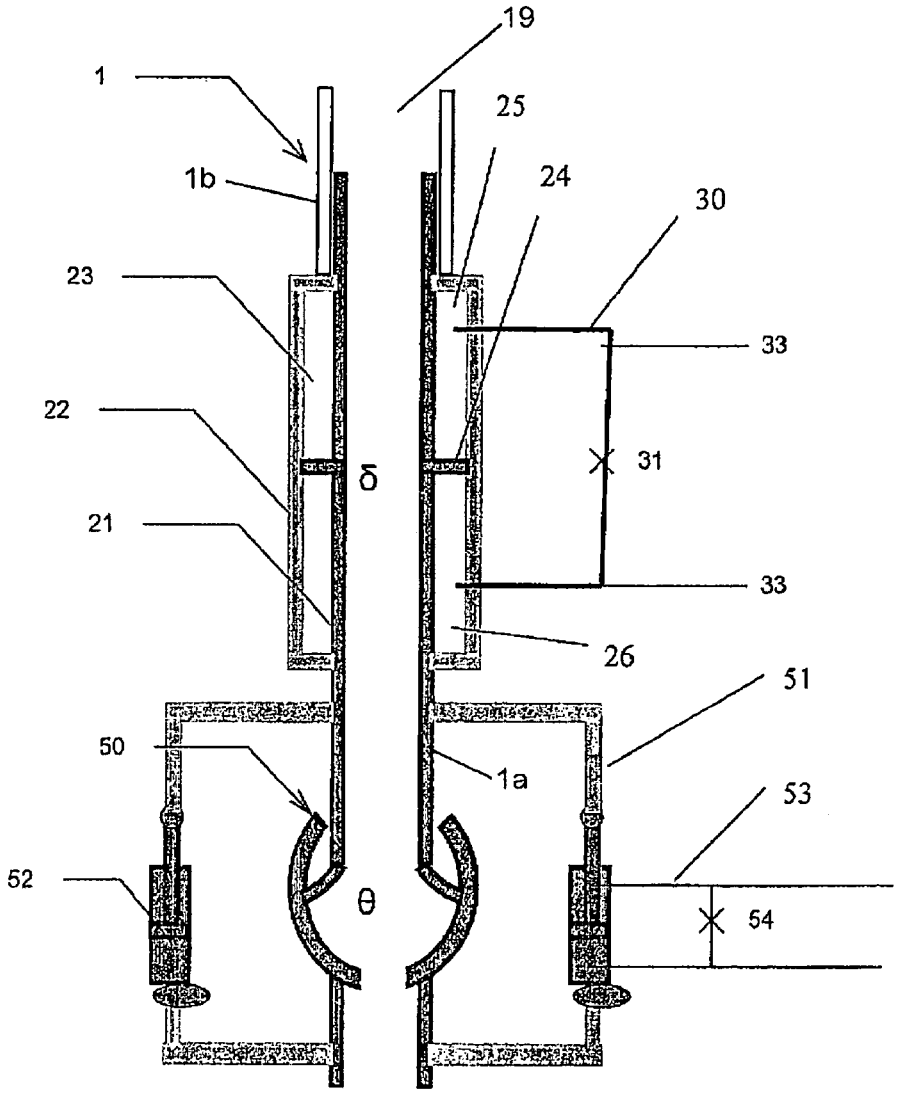
FIG. 2 shows a cross section of a first embodiment of a joint according to the invention for use in a riser as shown in FIG. 1.

In FIG. 2 a first embodiment of a joint is shown as a schematic cross section. The joint comprises an inner pipe segment 21 and an outer pipe segment 22. These pipe segments 21, 22 may move relative to each other in an axial direction of the pipe segments when the joint is activated. The inner pipe segment 21 is moved relatively out of the outer pipe segment 22, thereby extending the length of the joint. The inner pipe segment 21 is at one end configured to be attached to a lower riser segment 1*a* extending below the joint. The outer pipe segment 22 is also at one end, positioned on an opposite side of the joint, configured to be connected to an upper riser segment 1*b* extending above the joint. An inner passage through the two pipe segments 21, 22 will in a connected state form a continuing passage with the internal passage 19 in the riser. This inner passage through the pipe segments 21, 22 may be in line with the passage in the riser. The inner and outer pipe segments 21, 22 are configured such that there is formed a chamber 23 between them. This is for instance formed by having end flange parts formed by the outer pipe segment, as indicated in FIG. 2, but a skilled person will understand that there are other ways to form a chamber between the two pipe segments.

There is in the chamber 23 arranged a piston 24. The piston 24 is radially extending in the chamber 23 and thereby in abutment against both the inner pipe segment 21 and the outer pipe segment 22, and fixed relative one of the pipe segments. This piston 24 divides the chamber 23 into a first chamber part 25 and a second chamber part 26. The piston 24 is also so arranged that when the pipe segments 21, 22 are moved relatively each other one of the chamber parts will decrease in size and one will increase in size. The chamber part which decreases in size is according to the invention adapted to be filled with a mainly incompressible fluid and is during use filled with this incompressible fluid, which when the fluid is kept within this chamber part will due to its incompressibility prevent the pipe segments from relative movement in one direction, even with increased tension in the riser. This tension will be transferred to a pressure in the incompressible fluid in the one chamber part. There is provided a fluid line connection 30 between the first chamber part 25 and the second chamber part 26. In the first embodiment there is provided a burst disk 31 in this fluid line connection 30. This burst disk 31 is configured to break at a given pressure in the one chamber part 25 which will decrease in size when the inner pipe segment 21 is moved out of the outer pipe segment 22. This given pressure thereby forms a threshold value. There may be arranged sensors 33 in connection with the fluid line connection 30, possibly on both sides of the burst disk 31.

As shown in the figure a flex joint 50 is arranged relatively below the joint. The flex joint comprises an inner pipe segment and an outer pipe segment configured such that the center axes of the two pipe segments are allowed to form an angle between them. This will allow some angular deviation of the center axis of one of the pipe segments relative the center axis of the other pipe segment, other than keeping the pipe segments aligned. One possible configuration is shown in FIG. 2, where one pipe segment on one end is formed with a seat, partly similar to a sphere, for an end of the other pipe segment, having a complementary shape. This flex joint may be formed with control means for controlling when the two pipe segments are allowed to form a relative angular deviation from an alignment. There are operating arms 51 formed on both pipe segments. These operating arms are linked to a cylinder arrangement 52 on opposite sides of the flex joint. One pipe segment is linked to the cylinder of the cylinder arrangement and the other pipe segment is linked to a piston arranged in the cylinder. There is preferably arranged an incompressible fluid in the cylinder arrangement. There is further a fluid connection 53 between the two different sides of a piston in the cylinder arrangement 52 and a burst disk 54 in this connection. The flex joint is thereby allowed to deviate at a given pressure, and one may also control the rate for how fast the pipe segments are allowed to deviate by the dimension of the fluid connection line and the opening formed by the burst disk. There is as with the joint also the possibility to have a really slow movement by allowing some flow through before the disk bursts, and there is also the possibility to allow a more rapid movement. There may also be different cylinder arrangements around the flex joint to control the movement of the flex joint in different directions. The joint as shown in FIG. 2 may be used without the flex joint arranged below the joint.

Figure 3:
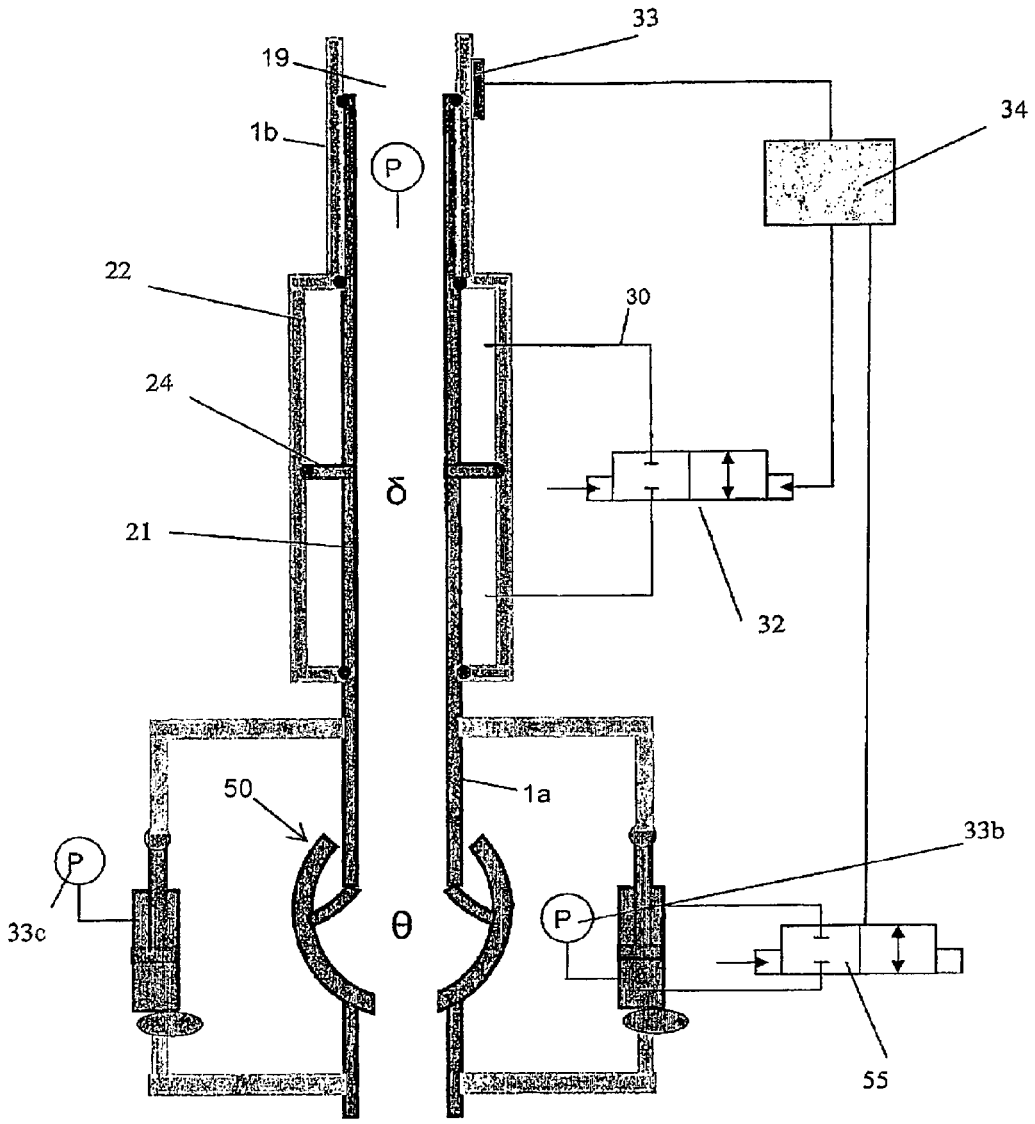
FIG. 3 shows a cross section of a second embodiment of a joint.

In an alternative embodiment of the flex joint as shown in FIG. 3, there is instead of the burst disk arranged a valve 55 in the fluid line. There may be arranged pressure sensors 33*b*, 33*c* in the different chamber parts in the cylinder arrangement and these may be used to operate the valve 55 in the fluid line.

In FIG. 3 there is also shown a cross section of a second embodiment of the joint. In this embodiment the fluid line connection 30 between the two chamber parts formed by the piston 24 between the inner pipe segment 21 and the outer pipe segment 22 comprises a valve 32. As indicated, this valve 32 may be controlled by a control module 34, which operates the valve in response to signals received from a sensor 33 reading the tension in the riser. Possibly the sensors 33*b*, 33*c* in the flex joint 50 may also provide information about the angular stress in the riser to the control module for input in the operation of the valve. The control module 34 may also be linked to the valve 55 in the flex joint. The control module may also control the operation of the valve 55 in the flex joint. As one may see from this embodiment the inner and outer pipe segments 21, 22 are formed such that they allow extension in the joint by, for instance, having an extension of the inner pipe segment 21 on the opposite side of the chamber parts. As indicated in the figure there is also arranged sealing elements between the different parts in the joint, as is the case in all the embodiments. The piston 24 may as shown in this embodiment be connected to the inner pipe segment 21. In an alternative embodiment the piston 24 may be connected to the outer pipe segment 22.

Figure 4:
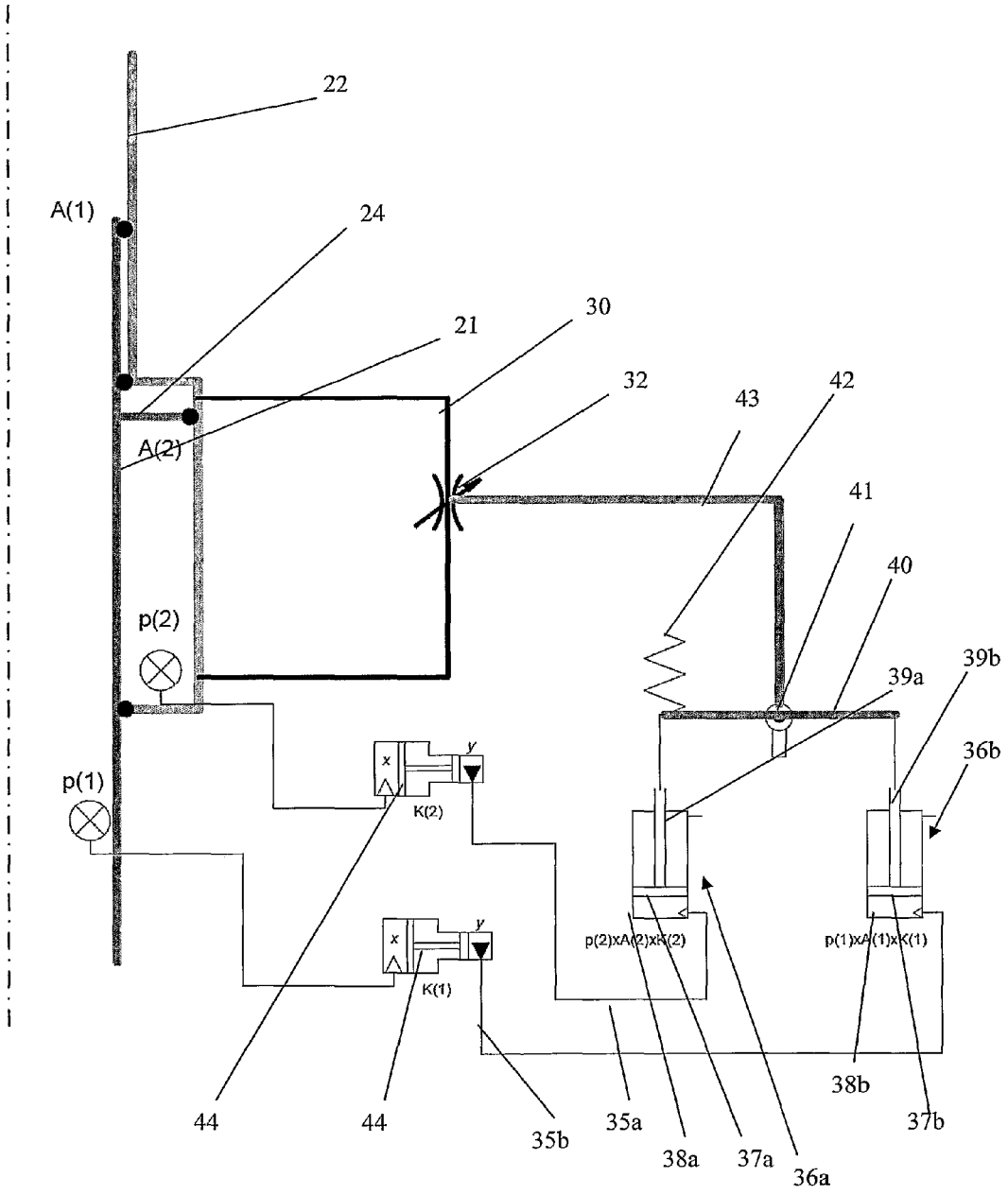
FIG. 4 shows a cross section of one side of a third embodiment.

In FIG. 4 there is shown a third embodiment of the joint. Only the different features from the previous embodiment will be described. In this embodiment the valve 32 in the fluid line connection 30 between the two chamber parts formed between the inner and outer pipe segments 21, 22 is mechanically operated. A fluid line 35*a* extends from one chamber part to one side of a piston 37*a* arranged in a cylinder 38*a* of a first cylinder arrangement 36*a*. The piston 37*a* is connected to a piston rod 39*a*. This piston rod 39*a* is attached to a lever arm 40 which is allowed to move relative a fulcrum 41. An increased pressure in the fluid within the chamber part will be transferred to the piston arrangement 36*a*, and there try to move the piston 37*a* with the piston rod 39*a* to rotate the lever arm 40 about the fulcrum 41. There is in this embodiment arranged a spring element 42 acting in the opposite direction of the pressure in the chamber part on the lever arm. The pressure in the chamber part must therefore be so large that it must act against the force of the spring element 42 to move the lever arm 40. Movement of the lever arm 40 will be translated to the operating arm 43, which then mechanically operates the opening and closing of the valve 32.

The arrangement in this embodiment is also compensated with regards to pressure of the fluid within the riser. This is done by having a fluid line 35*b* extending from the internal passage of the riser or joint and to a cylinder arrangement 36*b* similar to the other cylinder arrangement 36*a*. The pressure of the fluid within the riser acts on this cylinder arrangement 36*b*, which through the piston 37*b* and piston rod 39*b* act on the lever arm 40, however in the opposite direction of the influence of the other cylinder arrangement 36*a*. The piston rod 39*b* is connected to the lever arm 40 on the other side of the fulcrum. As the pressure of the fluid within the riser increases the pressure on the lever arm 40 increases giving that there need to be a larger pressure within the chamber part before the valve 32 is opened. This since the pressure within the chamber part which acts on the lever arm for opening the valve, now has to counteract both the force from the spring element and the force on the lever arm from the pressure of the fluid within the riser. There may as indicated also be arranged pressure intensifiers 44 in the fluid lines 35*a*, 35*b*. The system may be formed without the pressure intensifiers 44. For a riser without internal pressure the system may be formed without the fluid line 35*b* transferring the force from the fluid within the riser to the lever arm 40.

Figure 5:
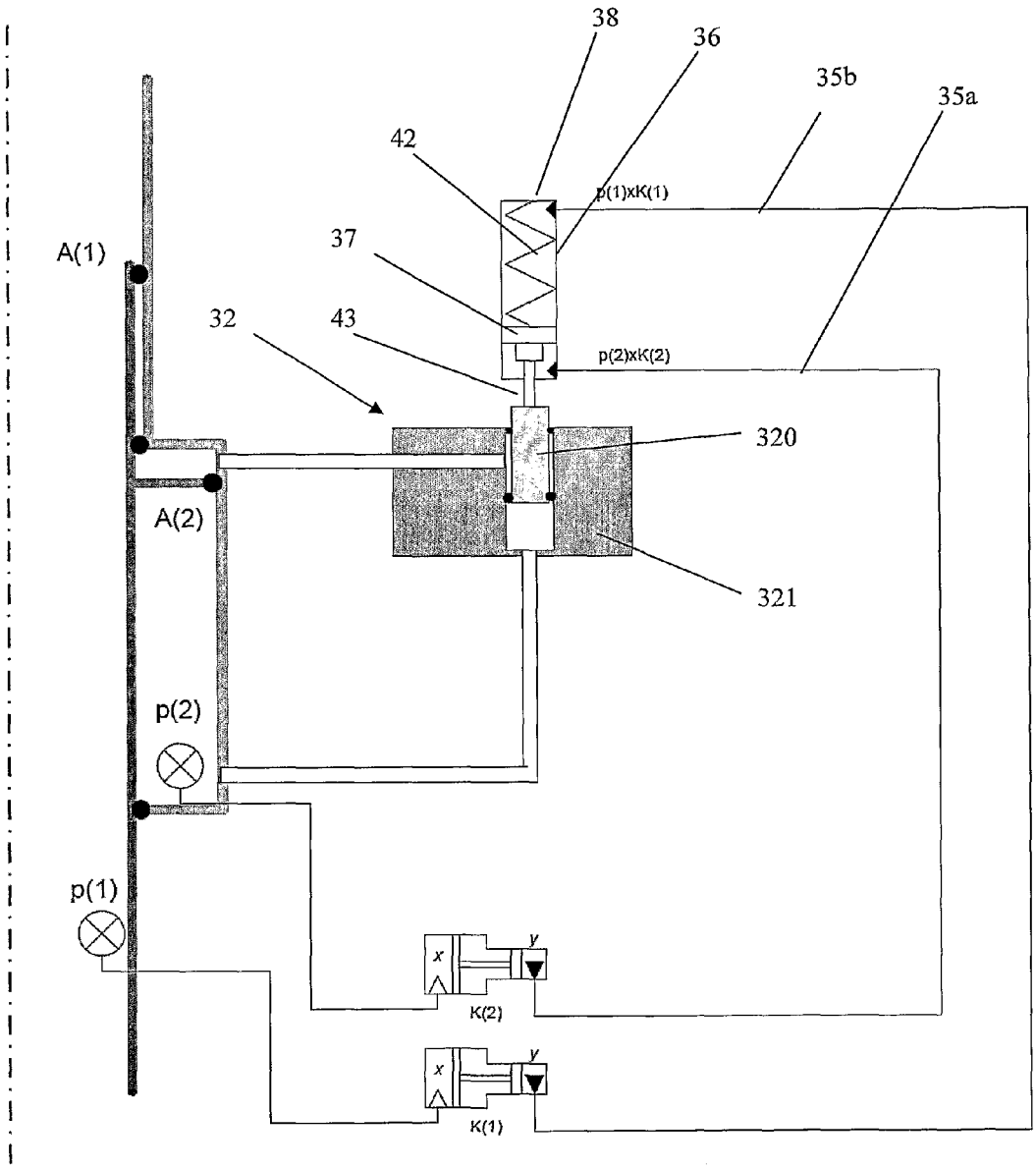
FIG. 5 shows a cross section of one side of a fourth embodiment.

In FIG. 5 there is shown a fourth embodiment of the joint. Only different features from the third embodiment will be described. In this embodiment the fluid lines 35*a* and 35*b* from the fluid within the chamber part and the fluid within the riser respectively are connected to a common cylinder arrangement 36. The fluid line 35*a* from the chamber part leads to one side of a piston 37 in a cylinder 38 and the fluid line 35*b* from the riser lead to the opposite side of the piston 37. This results in that the pressure of the fluid within the chamber part and the riser acts on opposite sides of the piston 37. The piston 37 comprises a piston rod 39 linked to an operating arm 43 for operation of a valve 32. A spring element 42 is also arranged to provide a pretension on the piston 37. In the shown embodiment the spring element 42 is arranged within the cylinder 38. It is possible to envisage the spring element 42 arranged in connection with the operating arm but outside the cylinder arrangement. The operating arm 43 is in this embodiment connected to a sliding valve element 320 which slides in a valve housing 321 to close or open the fluid connection line between the two chamber parts formed between the inner and outer pipe segment 21, 22.

Figure 6:
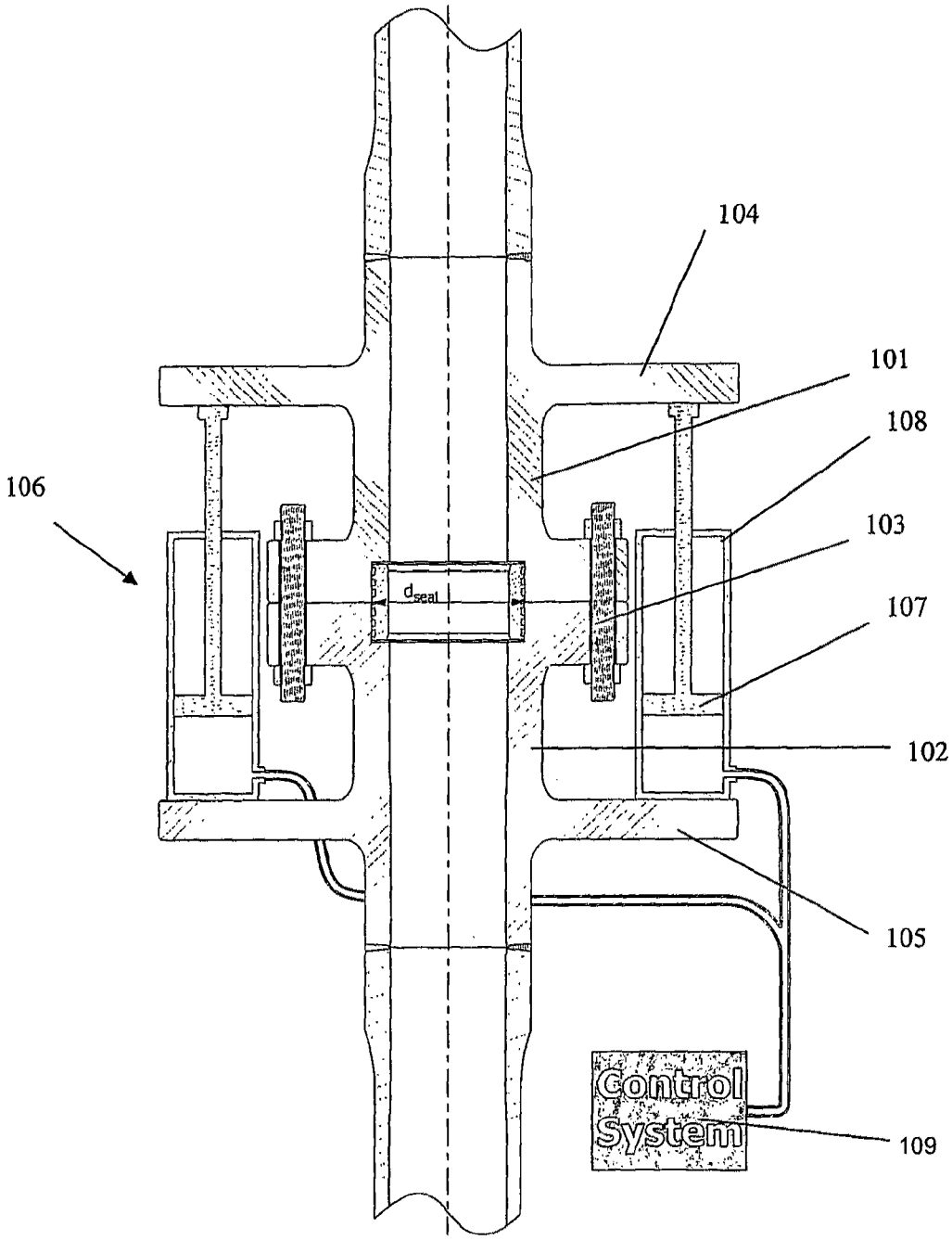
FIG. 6 shows a riser weak link which may be used in connection with the invention.

In addition to the joint as explained above there is the possibility of providing the riser with a special riser weak link, as shown in FIG. 6 and which will be described below. Such a riser weak link is typically situated above two standard joints above a lower taper stress joint where the bending moment is low.

Current system uses safety joints or weak links to protect the riser system and well installations from overload in case of fast drive-off or system stroke-out. The weak link is located above the barrier elements. The failure mode of the weak link may be to excessive tension as shown in U.S. Pat. No. 5,951,061, excessive bending as shown in NO 321184 or a combination of both. As discussed above there are different elements that induce tension in the riser, external forces or internal pressure within the riser.

There is therefore a need for a riser weak link with a break load independent of internal pressure in the riser system. Such a weak link will also provide a larger operational window compared to the current systems.

A weak link comprises two pipe segment joined by an element configured to break at a given tension in the pipe segments, to thereby separate the two pipe segments. The two pipe segments are at their opposite ends, in use, connected to respective riser parts. According to the invention the riser weak link comprises a preload package, which is connected to the respective riser segments and is configured such that the preload package can induce a tension across the weak link. This induced tension may be added independent of the tension in the riser as a whole. There is also the possibility of equipping known weak links with a preload package according to the invention.

By such a solution one may in cases with varying internal pressure or even where there is no internal pressure within the riser sill have the riser weak link to break at a predetermined tension, which equals an external added tension, by regulating the preload package according to any internal pressure in the riser. The breaking tension will be a tension in the riser from any internal fluid or added by the preload package when the internal pressure in the riser is below the design pressure and the external added pressure. When there is full internal pressure within the riser. The preload package may be turned off, i.e. not applying any tension to the riser weak link. Thereby the riser weak link will break at a given external tension applied to the riser, independent of the internal pressure in the riser. Such a solution also gives the possibility to have an "active" riser weak link, where one by using the preload package may apply tension to the weak link so that it breaks. One can then actively decide when the weak link should break.

One possible embodiment of a riser weak link according to the invention is shown in FIG. 6. The riser weak link comprises a first pipe segment 101 and a second pipe segment 102 connected by a break element 103. The pipe segments 101, 102 are provided with flange sections 104,105 where between a preload package 106 is arranged. The preload package 106 comprises in this embodiment a piston 107, cylinder 108 arrangement each connected to respective pipe segments 101, 102 and a control system 109 providing pressurized fluid into the piston/cylinder arrangement. The piston/cylinder arrangement thereby provides a tension across the weak link. By controlling the piston/cylinder arrangement the tension across the weak link is controlled. There are other possibilities for providing a preload package, one may use hydraulic force as explained, springs, thermal expansion, electric coil/magnet system, combinations or similar.

Figure 7:
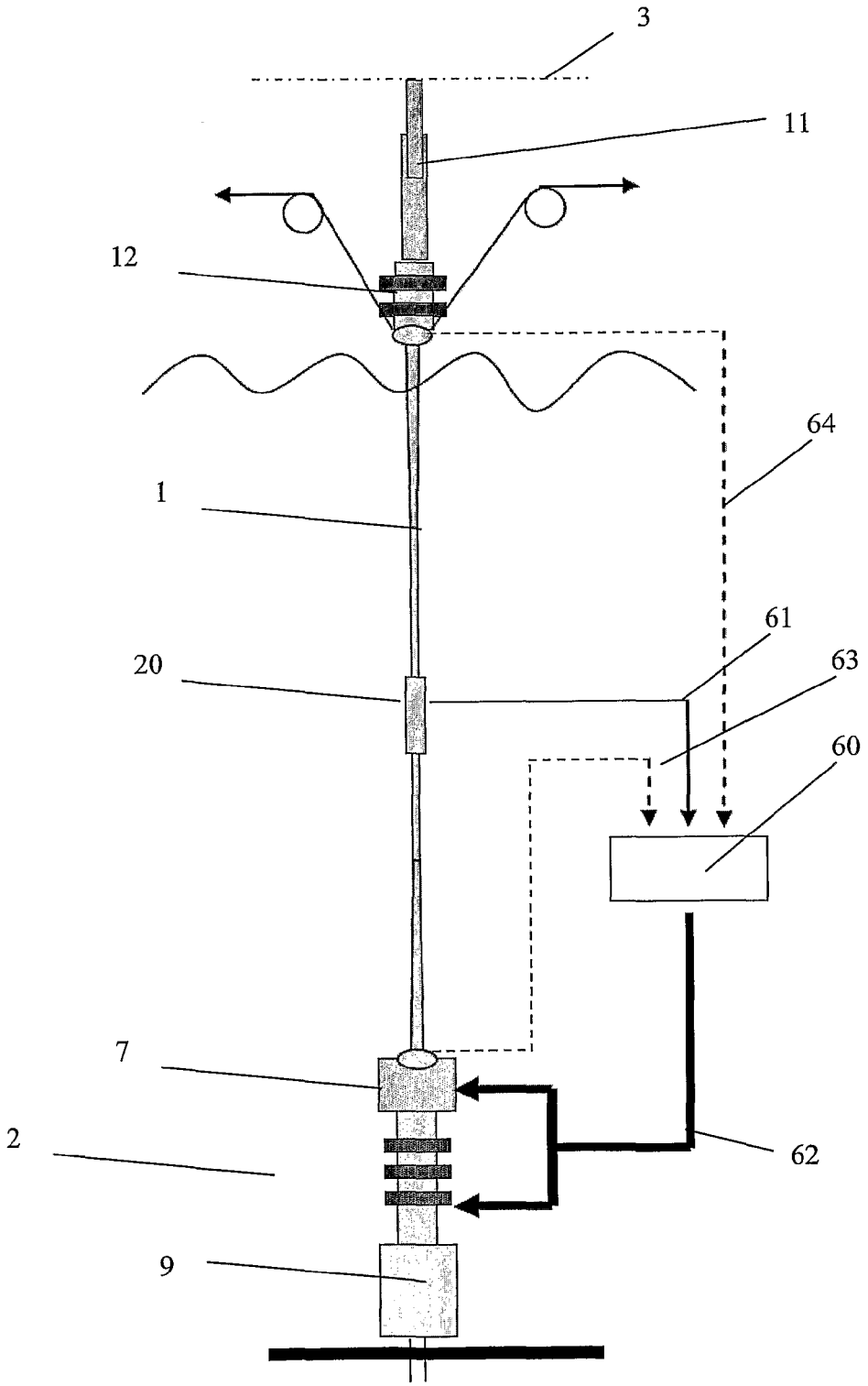
FIG. 7 shows another embodiment of the invention.

In FIG. 7 there is shown possible additional features of the invention, which may be used with all the different embodiments described above. There is in this figure shown a riser 1 with a joint 20, according to the invention, forming part of the riser extending from a subsea installation 2 arranged at the seabed to a floating unit 3. There is in the shown riser 1 arranged a subsea tree 9 and an emergency disconnect package 7 close to the seabed, and the joint 20 according to the invention between the emergency disconnect package 7 and a connection point for a tension system connected between the riser 1 and the floating unit 3. There is in addition arranged a surface BOP 12 and a telescopic joint 11 or slip joint in the upper part of the riser 1. The telescopic joint 11 is arranged above the connection of the tension system to the riser. According to the invention the joint 20 is through signal line 61 connected to a control unit 60. The signal or signals transmitted from the joint to the control unit 60 may represent the pressure of the fluid in the riser, within the chambers of the joint, the extension of the joint, the stress in the riser or other values in relation to the operation of the joint. The signal transmission between the control unit 60 and the joint 20 may also be wireless. This control unit 60 receives signals from the joint 20 and these signals may be communicated to an operator. The control unit 60 is also in communication with the emergency disconnect package 7, possibly through signal lines 62. When the signal from the joint 20 reaches a given value the control unit 60 will as a consequence of this activate the emergency disconnect package 7. The signal may be a representation of the extension of the joint 20, and when a given extension is reached then the emergency disconnect package 7 is activated. The control unit 60 may also receive signals from other parts of the riser, as indicated with signal lines 64, 63. These other signals may also be input to the processes in the control unit 60, which decides to activate the emergency disconnect package 7 or not or they may be transmitted to the operator.

The invention has now been explained with reference to different embodiments. A skilled person will understand that there may be made alterations and modifications to these embodiments that are within the scope of the invention as defined in the attached claims.

The invention claimed is:

1. In a riser extending between a floating installation and a subsea installation, the riser defining an internal riser passage and having at least two axially aligned riser segments, the improvement comprising a joint which includes:

concentric inner and outer pipe segments which are moveable relative to each other in an axial direction and are each connectable to a respective one of the two riser segments, said inner pipe segment defining an inner passage which is continuous with the riser passage;

an axially extending chamber which is formed between concentric portions of the inner and outer pipe segments, said chamber and said concentric portion of the outer pipe segment being isolated from the inner passage by said concentric portion of the inner pipe segment;

a radially extending piston which is connected to one of the inner and outer pipe segments and divides the chamber into axially spaced-apart first and second chamber parts which are isolated from the inner passage;

a fluid line connection extending between the first chamber part and the second chamber part;

wherein at least said first chamber part in an initial position of the joint contains a mainly incompressible fluid which when the inner pipe segment is moved relatively out of the outer pipe segment is forced by the piston from the first chamber part through the fluid line connection and into the second chamber part; and a flow control device which controls the flow of said fluid from the first chamber part through the fluid line connection to the second chamber part to thereby control the relative movement of the inner and outer pipe segments.

2. The riser according to claim 1, wherein the flow control device comprises a burst disk which is positioned in the fluid line connection.

3. The riser according to claim 1, wherein the flow control device comprises a regulating valve which is positioned in the fluid line connection.

4. The riser according to claim 3, further comprising a control module connected to a sensor for reading the tension in the riser, wherein the control module actuates the regulating valve in response to the sensor readings.

5. The riser according to claim 3, wherein fluid pressure within the first chamber part acts on a mechanical control device for the regulating valve.

6. The riser according to claim 5, further comprising a first fluid line which is connected between said first chamber part and a first piston arrangement which acts on an operating arm for the regulating valve in response to the fluid pressure in the first chamber part.

7. The riser according to claim 5, wherein pressure within the riser passage acts on the mechanical control device.

8. The riser according to claim 6, further comprising a second fluid line which is connected between the riser passage and a second piston arrangement which acts on the operating arm in response to fluid pressure in the riser passage.

9. The riser according to claim 8, wherein each of the first and second piston arrangements comprises a cylinder having a piston with a piston rod, the piston arrangements being connected to respective ones of the first and second fluid lines and the operating arm comprising a lever arm, wherein the distal ends of the two piston rods act on the lever arm to move the lever arm in opposite directions relative a fulcrum.

10. The riser according to claim 8, wherein at least one of the first and second fluid lines comprises a pressure intensifier.

11. The riser according to claim 8, wherein at least one of the first and second piston arrangements is biased by a spring element.

12. The riser of claim 1, further comprising an emergency quick disconnect package (EQDP), wherein the joint is located between the floating installation and the EQDP.

13. The riser according to claim 12, further comprising a flex joint which is located between the EQDP and the joint.

14. The riser according to claim 13, further comprising a control unit connected to both the joint and the EQDP and configured to at least receive signals from the joint, process the signals and send the signals to the EQDP.

15. The riser according to claim 14, wherein the control unit also receives signals from other parts of the riser.

16. The riser according to claim 14, further comprising a control module connected to a sensor for reading a tension in the riser, wherein the control module also receives signals from a number of sensors which are connected to the flex joint.

17. The riser according to claim 16, wherein the control module is connected to or forms part of the control unit for the riser.

18. A method for increasing the operation window of a riser extending between a floating installation and a subsea installation, the method comprising the steps of:

providing a joint according to claim 1 between the floating installation and an EQDP; and when the floating installation deviates from its operational window and thereby increases the tension in the riser, controlling the outflow of fluid from the first chamber part to thereby control the extension rate of the joint, thereby increasing the available time to release the EQDP.

* * * * *